US008109780B2

(12) United States Patent
Addison et al.

(10) Patent No.: US 8,109,780 B2
(45) Date of Patent: Feb. 7, 2012

(54) TAMPER PREVENTION AND DETECTION APPARATUS FOR AN ELECTRONIC DEVICE

(75) Inventors: Danny H. Addison, Durham, NC (US); David C. Brower, Wake Forest, NC (US); Robert J. Heider, Durham, NC (US); Dean F. Herring, Youngsville, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/817,225

(22) Filed: Jun. 17, 2010

(65) Prior Publication Data

US 2011/0312214 A1 Dec. 22, 2011

(51) Int. Cl.
*H01R 13/62* (2006.01)

(52) U.S. Cl. ..... 439/372

(58) Field of Classification Search ..... 439/372, 439/347, 362, 137, 142, 373, 939; 324/110; 361/369

See application file for complete search history.

(56) References Cited

U.S. PATENT DOCUMENTS

| | | | | |
|---|---|---|---|---|
| 4,040,279 | A | 8/1977 | Signorelli et al. | |
| 4,346,345 | A | 8/1982 | Welz | |
| 4,544,219 | A * | 10/1985 | Barkas | 439/137 |
| 4,990,888 | A | 2/1991 | Vogt et al. | |
| 5,945,915 | A | 8/1999 | Cromer et al. | |
| 6,518,565 | B1 | 2/2003 | Wu et al. | |
| 6,739,886 | B1 | 5/2004 | Robinson et al. | |
| 6,786,745 | B1 * | 9/2004 | Huang | 439/137 |
| 7,390,201 | B1 | 6/2008 | Quinby et al. | |
| 7,476,112 | B2 | 1/2009 | O'Connell et al. | |
| 7,661,981 | B2 | 2/2010 | Cross et al. | |
| 7,874,864 | B2 * | 1/2011 | Luu | 439/373 |
| 2007/0020976 | A1 | 1/2007 | Tirtosupono | |
| 2008/0320552 | A1 | 12/2008 | Kumar et al. | |
| 2009/0293136 | A1 | 11/2009 | Campbell et al. | |

FOREIGN PATENT DOCUMENTS

GB 2234401 A 1/1991

* cited by examiner

*Primary Examiner* — Alexander Gilman
(74) *Attorney, Agent, or Firm* — Olive Law Group, PLLC; Thomas E. Tyson

(57) ABSTRACT

An apparatus for preventing and detecting tampering of an electronic device is provided. The apparatus may prevent and detect tampering occurring through an aperture in a casing of the electronic device where the aperture is configured for receiving a standoff that couples a communication cable to a communication port of the electronic device. Upon removal of the standoff, visual indicia of tampering may be provided. Additionally, a shield may block entry of the standoff into the aperture if the standoff is removed.

20 Claims, 6 Drawing Sheets

TAMPER PREVENTION AND DETECTION APPARATUS FOR AN ELECTRONIC DEVICE

BACKGROUND

1. Field of the Invention

The present invention relates to a tamper prevention and detection apparatus for electronic devices, and more specifically, to a tamper detection apparatus for preventing and detecting tampering of an electronic device through a communication port.

2. Description of Related Art

In many modern electronic systems such as personal computers, various communication ports are provided in communication with the electronic system for communicating with various external accessories. For example, a printer may be connected to the electronic system via a cable to communicate with a communication port. As another example, a display monitor may be connected to the electronic system via a cable to also communicate with a communication port. These ports may be input/output ("I/O") ports, or may be one-way communication ports.

The communication ports and cables may be coupled together in a variety of ways, but typically the communication port is recessed within the casing of the electronic device so that the communication port does not protrude from beyond the casing and risk damage to the communication port. Accordingly, the cable will typically be inserted into and received within the recessed communication port. Various methods and products have been developed in order to secure the cable into the communication port. For example, the communication port may have a spring loaded gripper configured for engaging a corresponding recess formed on the cable such as may be found on Universal Series Bus ("USB") ports. In another instance, the cable could have a gripper with a detent formed thereon that engages a corresponding recess formed in the communication port such as may be used on telephony or Ethernet cables. In another instance, the cable may have a cylindrical shaped portion that interferencely engages a correspondingly shaped portion such as may be used for audio devices, including head phones and speaker cables.

In another instance, the communication port of the electronic device may be a pin type connector for coupling and communicating with communication cables such as a parallel port for use with printers or a Video Graphics Array ("VGA") for use with display monitors. For these types of communication ports, the cable must be secured to the communication port to prevent entry and removal of the cable into the port and to protect the communication pins in the connector. Due to the cantilevered design of the communication pins, the pins are easily damaged by bending or breaking. For this reason, additional coupling mechanisms must be employed for pin type connectors.

One method of securing a pin type communication cable to a communication port of an electronic device is by the use of a threaded standoff that serves the purpose of receiving a fastener coupled with the communication cable to thereby secure the communication cable to the communication port. The standoff is typically secured to a casing of the electronic device by engaging a threaded portion formed in an aperture of the casing. The fastener of the communication cable is typically a threaded shaft that is configured for threading within an internally threaded portion of the standoff. Unfortunately, this arrangement requires that the standoff be exposed on an exterior of the casing. This allows for easy removal of the standoff and subsequent tampering of the electronic system through an aperture of the casing. In some instances, this tampering could cause extensive damage to the electronic device and may also void any warranty on the device, however, such tampering is difficult to detect because the tampering party can simply replace the standoff and leave no evidence of tampering behind.

Tampering is particularly problematic for countries using fiscal monitoring systems to monitor the financial transactions that may occur at any given business. These fiscal monitoring systems may include a computer having a circuit board with a central processor that records relevant financial data and a printer that prints out the relevant financial data. This computer is attached to a register, credit card reader, or other machine via a communication cable. In some instances, these systems have been tampered with by removing the standoff in order to gain access into the computer or printer by any number of ways, including using an elongate metal wire to contact and short out the device's circuit board. Upon shorting out of the circuit board, the system is no longer able to monitor financial transactions occurring at that business. This could result in a loss of revenue and financial information, as well as leaving a business owner subject to certain liabilities.

Accordingly, there is a need for some manner in which to prevent and detect tampering of electronic devices through communication ports of this type.

BRIEF SUMMARY

One or more embodiments of the present invention provide an apparatus having a shield for preventing and detecting tampering of an electronic device through a bore configured for receiving a standoff for coupling with a communication cable. The shield may have a first position in which the shield prevents pass-through into the bore and a second position in which the shield allows pass-through of the standoff into the bore. The shield may be biased towards the first position by a spring.

One or more embodiments of the present invention provide an apparatus having a shield that defines an aperture for allowing selective pass-through of a standoff into a bore configured for receiving the standoff. The shield may be moveable between a first position in which the aperture is offset from the bore, thereby restricting pass-through of the standoff into the bore, and a second position in which the aperture is generally aligned with the bore, thereby allowing pass-through of the standoff into the bore.

One or more embodiments of the present invention provide an apparatus having a shield for detecting tampering of an electronic device through a bore configured for receiving a standoff for coupling with a communication cable. The shield includes an elongate elliptical spring and a cover on at least one end thereof. The shield may be moveable from a first position in which the cover obstructs the bore thereby restricting pass-through of the standoff therethrough, and a second position in which the cover does not obstruct the bore thereby allowing pass-through of the standoff therethrough.

One or more embodiments of the present invention provide an apparatus having a shield for detecting tampering of an electronic device through an aperture configured for receiving a standoff for coupling with a communication cable. The shield has a slider defining an aperture configured for engaging the standoff and is slideable from a first position in which the aperture is offset from the bore and a second position in which the aperture is generally aligned with the bore to allow pass-through of the standoff therethrough.

DETAILED DESCRIPTION

Exemplary apparatuses for shielding and preventing tampering of an electronic device through a communication port in accordance with embodiments of the present invention are described herein. Particularly, described herein are exemplary apparatuses having shields that are selectively positionable to prevent tampering of an electronic device through a communication port of an electronic device, such as, but not limited to, fiscal accounting monitoring systems or printers. Apparatus of the present invention may prevent tampering of electronic devices having fiscal accounting information stored thereon and the subsequent loss or compromise of such fiscal accounting information.

Figure 1:
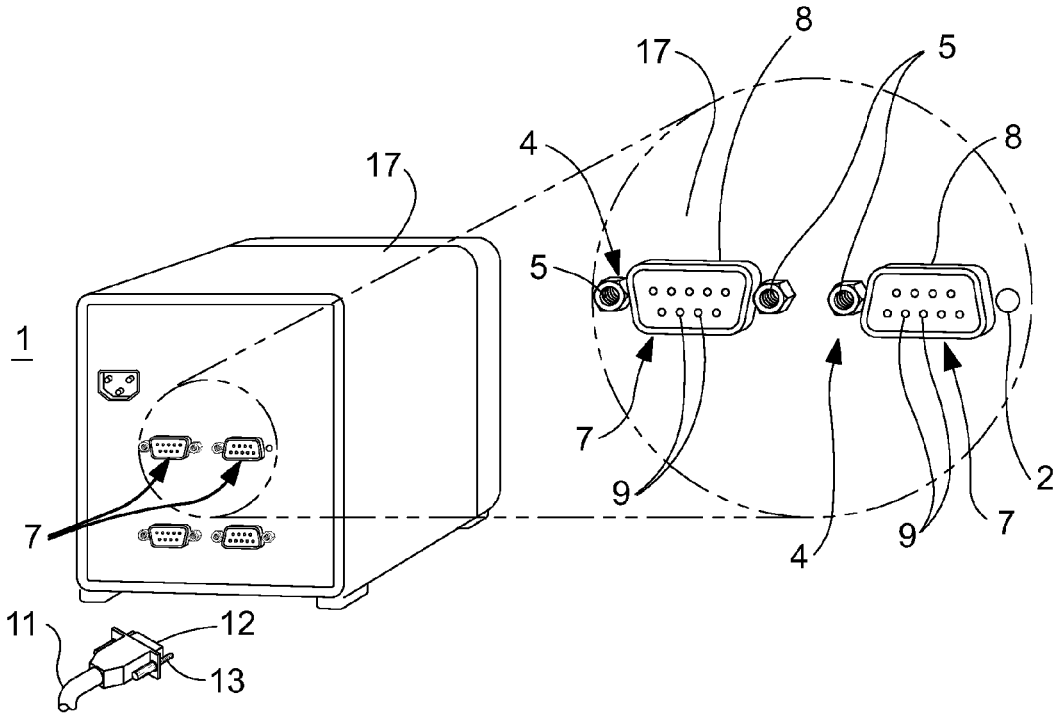
FIG. 1 sets forth a perspective view of an electronic device having communication ports, with the communication ports being illustrated in an enlarged, sectional view in accordance with embodiments of the present invention.

FIG. 1 illustrates a perspective view of an electronic device 1, which as illustrated may be a fiscal accounting monitoring computer, or in alternate embodiments may be any appropriate electronic device such as a personal computer, display monitor, printer, or the like. The electronic device 1 includes a casing 17 which is configured for covering the internal components of the electronic device 1. The electronic device may include at least one communication port, and in particular, may include at least one pin-type communication port 7. A fastener may be provided on each opposing horizontal side of the communication port 7 for securing to a cable 11 having a pin housing 12, and in one embodiment, may be an electrical standoff 4 having an internally threaded portion 5 that is configured for receiving a threaded portion of fastener 13 of cable 11. The cable 11 likewise has a fastener 13 configured for engaging the standoff 4 and thereby securing the cable 11 to the communication port 7.

Figure 2B:
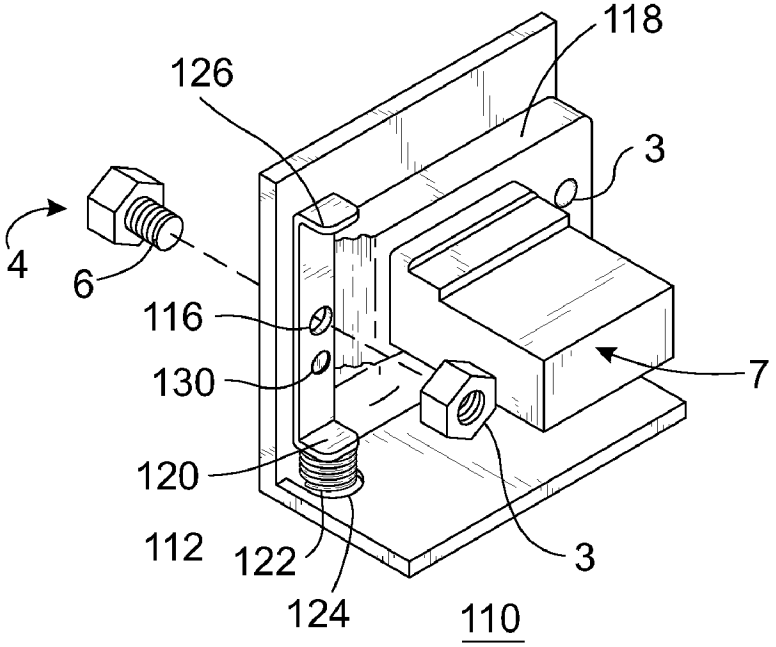
FIG. 2B sets forth a perspective view of the exemplary tamper detection apparatus of FIG. 2A in a second position in accordance with embodiments of the present invention.
Figure 2A:
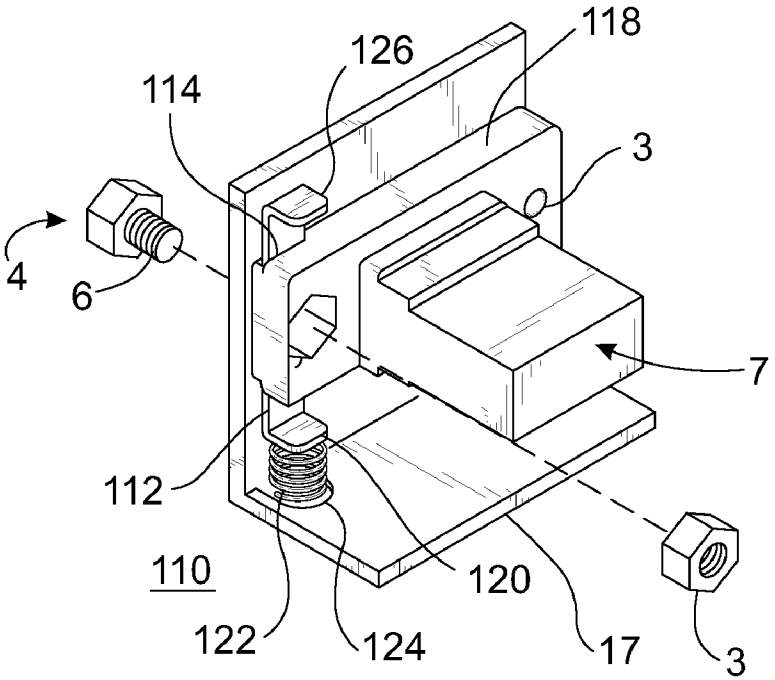
FIG. 2A sets forth a perspective view of an exemplary tamper detection apparatus in a first position in accordance with embodiments of the present invention.

With additional reference to FIGS. 2A and 2B, the standoff 4 includes a threaded shank 6 carried by the internally threaded portion 5. The threaded shank 6 of the standoff 4 is configured for being inserted into an aperture 2 defined in the casing 17 and received in a bore coaxially aligned therewith and defined in an interior of the casing 17. This bore may be a threaded bore 3 that is optionally integrally formed with the casing 17 of communication port 7 or may be separately formed such as illustrated as separate threaded nut in FIG. 2B. Is this manner, the standoff 4 is threadably engaged within threaded bore 3 and thereby secured to casing 17. Standoff 4 is removed by being unthreaded from the threaded bore 3. This leaves aperture 2 exposed such that tampering could occur therethrough. A tamper detection apparatus according to embodiments of the present invention is provided to alert a user that the communication port 7 has been tampered with and is illustrated throughout the drawings. Like elements are represented by like reference numerals throughout the detailed description. In each of the illustrations disclosed herein, there may be depicted one tamper detection apparatus for each port 7, however, any number of tamper detection apparatuses may be provided.

FIGS. 2A and 2B illustrate a perspective view of a tamper detection apparatus 110 for detecting the tampering of the communication port 7 according to embodiments of the disclosed subject matter. The tamper detection apparatus 110 is shown installed on a cut-out portion of casing 17. The communication port 7 includes a base 118. A slot 114 is defined in the base 118 and is sized so as to allow slideable movement therein of a shield 112. The shield 112 has a first engaging surface 120 formed on a first end thereof and a second engaging surface 126 on a second end thereof. The first engaging surface 120 is configured for engaging a spring 122 that is nested within a recess 124. The second engaging surface 126 is configured for receiving translational movement from an operator to impart sliding movement of the shield 112 within slot 114.

The shield 112 includes an aperture 116 which selectively restricts pass-through of the standoff 4 when the shield 112 is in the first position and allows pass-through of the standoff 4 when the shield 112 is in a second position. The shield 112 is placed in the second position by depressing the second engaging surface 126 such that the aperture 116 of the shield is generally aligned with the aperture 2 of the casing 17 so that the threaded shaft 6 of the standoff 4 can pass therethrough. Upon removal of the standoff 4, the spring 122 biases the shield 112 to return to the first position in which the shield does not allow pass-through of the standoff 4 because the aperture 116 of the shield is not generally aligned with the aperture 2 of the casing 17. A detent 130 may be provided on both the port facing side and cable facing side of the shield 112 and may have a bright marking or appearance so as to provide a visible indication of tampering with the communication port 7.

In order to install the standoff 4, the port 7 is positioned proximal the casing 17 such that standoff 4 is generally aligned with the aperture 2 and threaded bore 3. The shield 112 is then slid towards the spring 122 and, once the aperture 116 and aperture 2 are generally aligned, the standoff 4 is inserted therethrough and threadably engaged with the threaded bore 3. If the standoff 4 is removed such that the threaded shank 6 is no longer within the aperture 116 of the shield 112, the spring 122 biases the shield 112 upwards into the first position such that the shield blocks entry beyond aperture 2 from outside of the casing 17. Once the shield 112 is in the first position, the operator must then remove casing 17 in order to re-install standoff 6. Casing 17 may include a seal that is broken upon removal from the electronic device 1 so as to provide evidence of tampering if the standoff 4 is re-installed.

Figure 3A:
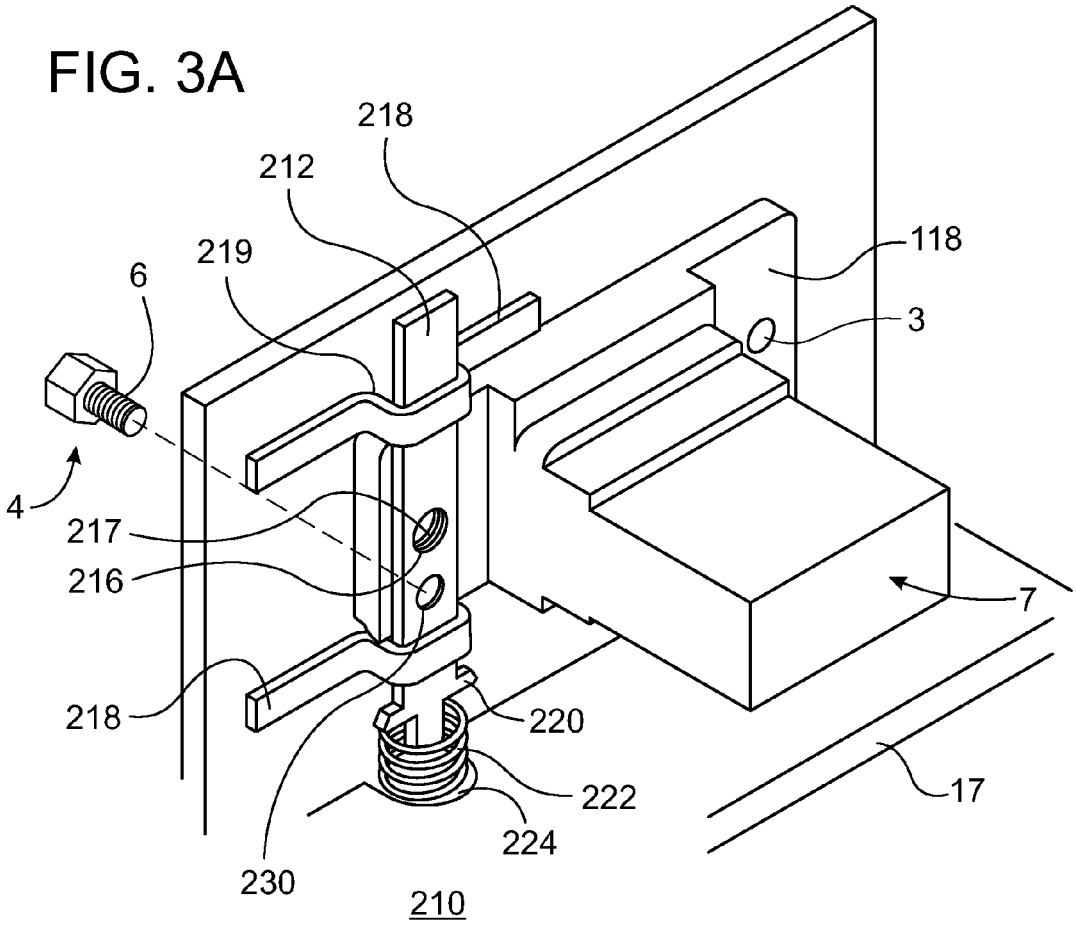
FIG. 3A sets forth a perspective view of an exemplary tamper detection apparatus in a first position in accordance with embodiments of the present invention.
Figure 3B:
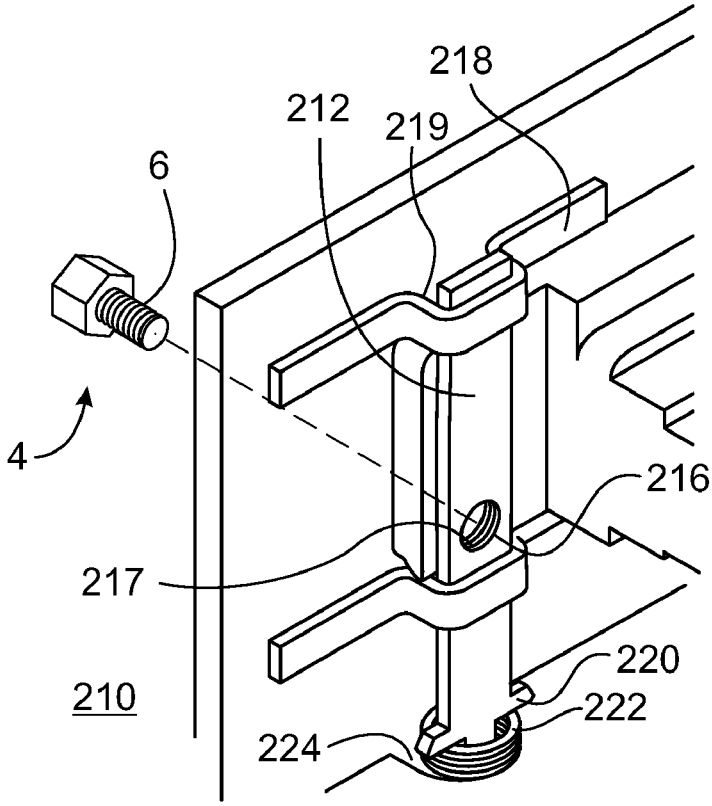
FIG. 3B sets forth a perspective view of the exemplary tamper detection apparatus of FIG. 3A in a second position in accordance with embodiments of the present invention.

FIGS. 3A and 3B illustrate other embodiments of a tamper detection apparatus 210. The tamper detection apparatus 210 includes a shield 212 that is slideably positioned within a recess 219 defined between the at least one bracket 218 and the base 118 of port 7. The shield 212 includes an aperture 216 that has an internally threaded portion 217 for receiving the threaded shank 6 of the standoff 4. The shield 212 also defines a T-shaped spring engaging member 220 that engages a coil spring 222 that is nested within a recess 224 defined in the casing 17. The shield 212 is configured such that aperture 216 is offset from aperture 2 of the casing 17 so that the shield 212 restricts pass-through of the standoff 4 beyond the aperture 2 when the shield 212 is in a first position as illustrated in FIG. 3A. The shield 212 is placed in a second position in which the shield is depressed towards the spring 222 until aperture 216 is generally aligned with aperture 2 of the casing 17 so that the threaded shank 6 of the standoff 4 can pass through aperture 2 and into engagement with aperture 216 as illustrated in FIG. 3B. Upon removal of the standoff 4, the spring 222 biases the shield 212 to return to the first position in which the shield 212 does not allow pass-through of the threaded shank 6 standoff 4. A detent 230 may be provided on both the port facing side and cable facing side of the shield 212 and may have a bright marking or appearance so as to provide a visible indication of tampering with the communication port 7.

Figure 4A:
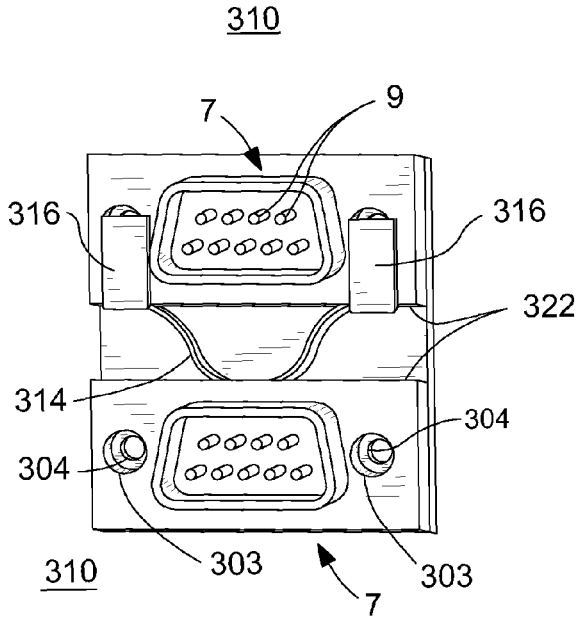
FIG. 4A sets forth a perspective view of an exemplary tamper detection apparatus in a first position in accordance with embodiments of the present invention.
Figure 4B:
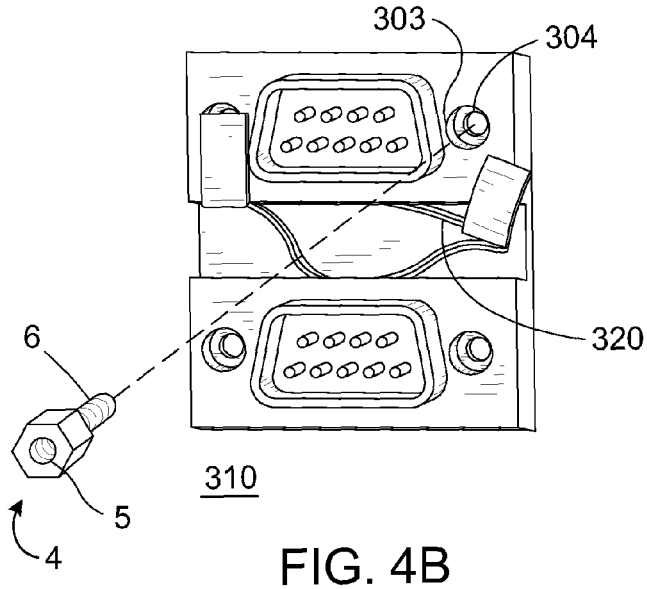
FIG. 4B sets forth a perspective view of the exemplary tamper detection apparatus of FIG. 4A in a second position in accordance with an embodiment of the present invention.

FIGS. 4A and 4B illustrate other embodiments of a tamper detection apparatus 310. The apparatus 310 includes an elliptical spring 314 that has a cover 316 on at least one end thereof, and in other embodiments, may have a cover 316 on each end of the elliptical spring 314 as illustrated in FIGS. 4A and 4B. The apparatus 310 may further include a support spring 320 that spans from each cover 316.

The apparatus 310 has a first position as illustrated in FIG. 4A in which each cover 316 blocks entry of the threaded shank 6 of the standoff 4 into a threaded portion 304 defined in a recess 303 and a second position in which each cover 316 is translated downward so as to not block entry of the threaded shank 6 of the standoff 4 into the threaded portion 303. The apparatus 310 is configured such that it has a dimension that is approximately equal to a dimension between opposing bases 322 of opposing ports 7 such that the apparatus 310 can be inserted between the opposing bases 322. The casing 17 is then installed so that the apparatus 310 is positioned between the port 7 and the casing 17.

Figure 5A:
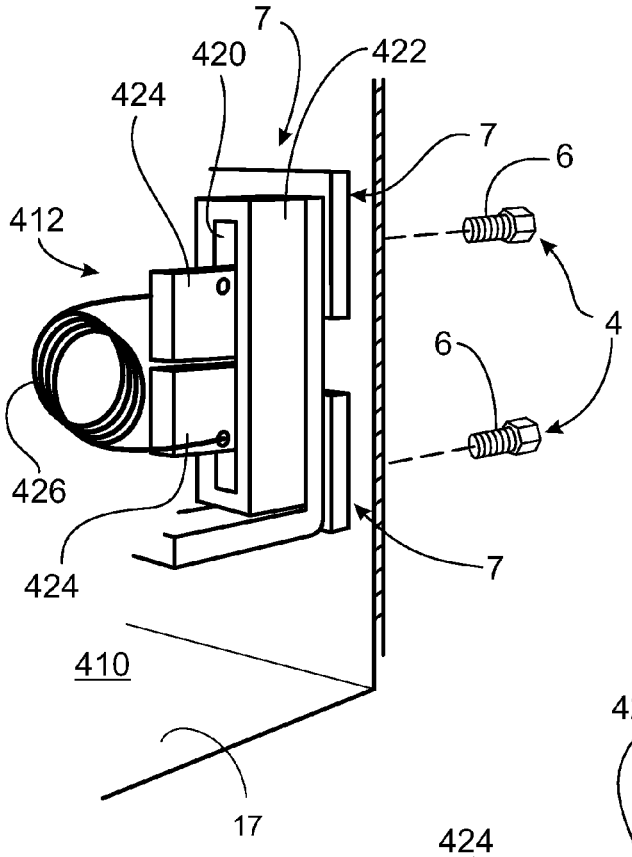
FIG. 5A sets forth a perspective view of an exemplary tamper detection apparatus in a first position in accordance with an embodiment of the present invention.
Figure 5B:
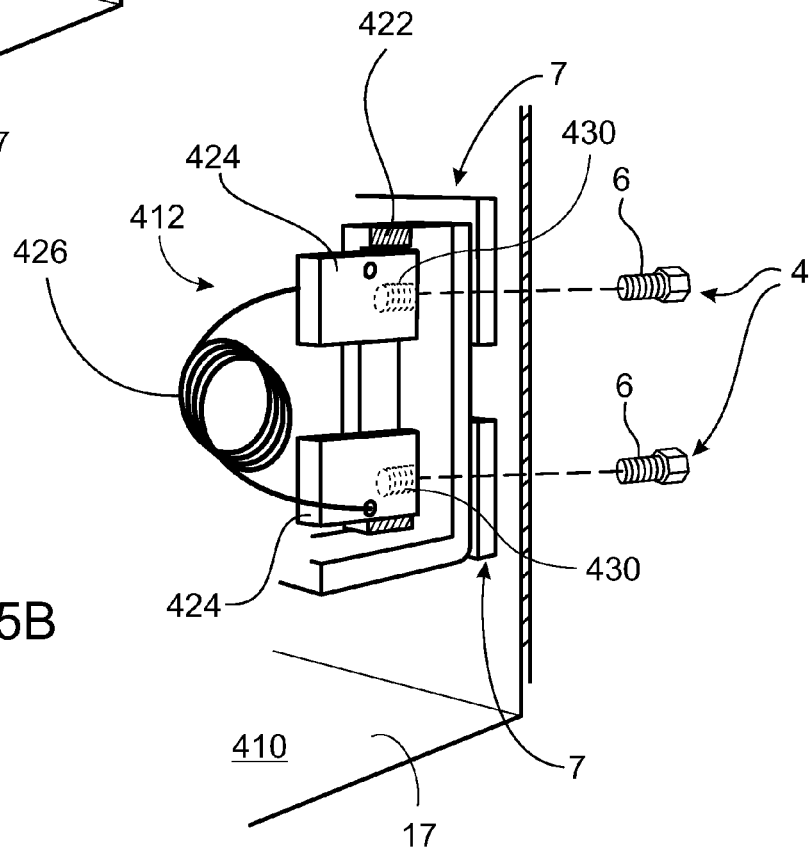
FIG. 5B sets forth a perspective view of the exemplary tamper detection apparatus of FIG. 5A in a second position in accordance with an embodiment of the present invention.

FIGS. 5A and 5B illustrate a tamper detection apparatus 410. The apparatus includes a shield 412 having first and second slider blocks 424. The slider blocks 424 are positioned within a slot 420 defined in a base 422 of the communication port 7. The slider blocks 424 are interconnected by a coil spring 426 that biases each of the slider blocks 424 to a closely-spaced, first position as illustrated in FIG. 5A. The slider blocks 424 define an internally threaded bore 430 that is configured for receiving the threaded shank 6 of a standoff 4. When the apparatus 410 is in the first position as illustrated in FIG. 5A, the bores 430 of the slider blocks 424 are not in alignment with the aperture 2 of the casing 17 such that the threaded shank 6 of the standoff 4 cannot be engageably received in the bore 430. The apparatus 410 is placed in a second position in which the slider blocks 424 are spaced-apart until the bores 430 are in general alignment with the aperture 2 of the casing 17 as illustrated in FIG. 5B. In this manner, the threaded shank 6 of the standoff 4 can then be engageably received within bore 430 and the connector 6 can then be installed on the casing 17.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus comprising:

a shield for preventing and detecting tampering of an electronic device through a bore configured for receiving a standoff for coupling a communication cable with a communication port, the shield having a first position in which the shield prevents pass-through of the standoff into the bore and a second position in which the shield allows pass-through of the standoff into the bore, wherein the shield defines an aperture for allowing selective pass-through of the standoff into the bore and the bore defines an internally threaded portion that is configured for engageably receiving a threaded portion of the standoff.

2. The apparatus according to claim 1, wherein the shield is biased towards the first position.

3. The apparatus according to claim 2, wherein the shield is biased towards the first position by a spring.

4. The apparatus according to claim 1, wherein the shield is slideable from the first position to the second position.

5. An apparatus comprising:

a shield for preventing and detecting tampering of an electronic device through a bore configured for receiving a standoff for coupling a communication cable with a communication port, the shield defining an aperture for allowing selective pass-through of the standoff into the bore and moveable between a first position in which the aperture is offset from the bore, thereby restricting pass-through of the standoff into the bore, and a second position in which the aperture is generally aligned with the bore, thereby allowing pass-through of the standoff into the bore, wherein at least one of the aperture and the bore defines an internally threaded portion that is configured for engageably receiving a threaded portion of the standoff.

6. The apparatus according to claim 5, wherein the shield is biased towards the first position.

7. The apparatus according to claim 5, wherein the shield is slideably positioned within a slot defined in a base of the communication port.

8. The apparatus according to claim 7, wherein the shield defines a spring engagement surface that is in engagement with a spring that biases the shield towards the first position.

9. The apparatus according to claim 8, wherein the shield defines an engagement surface for imparting movement of the shield from the first position to the second position.

10. The apparatus according to claim 5, wherein the aperture defines the internally threaded portion that engageably receives a threaded portion of the standoff.

11. The apparatus according to claim 5, wherein the shield is carried by at least one bracket defining a recess therein for slideably receiving the shield.

12. An apparatus comprising:

a shield for preventing and detecting tampering of an electronic device through a bore configured for receiving a standoff for coupling a communication cable with a communication port, the shield having an elongate elliptical spring and a cover on at least one end thereof and moveable from a first position in which the cover obstructs the bore thereby restricting pass-through of the standoff therethrough, and a second position in which the cover does not obstruct the bore thereby allowing pass-through of the standoff therethrough, wherein the bore defines an internally threaded portion that is configured for engageably receiving a threaded portion of the standoff.

13. The apparatus according to claim 12, wherein the spring defines a dimension sized to match a dimension between opposing bases of spaced-apart communication ports such that the shield nests between the opposing bases of spaced-apart communication ports.

14. The apparatus according to claim 13, wherein the shield is positioned between the opposing bases of spaced-apart communication ports and a casing covering the electronic device such that the shield is covered by the casing when installed on the electronic device.

15. The tamper detection apparatus according to claim 12, wherein, upon removal of the standoff, the shield is biased into the first position.

16. An apparatus comprising:

a shield for preventing and detecting tampering of an electronic device through a bore configured for receiving a standoff for coupling a communication cable with a communication port, the shield having a slider defining an aperture configured for allowing selective pass-through of the standoff and being slideable from a first position in which the aperture is offset from the bore and a second position in which the aperture is generally aligned with the bore to allow pass-through of the standoff therethrough, wherein at least one of the aperture and the bore defines an internally threaded portion that is configured for engageably receiving a threaded portion of the standoff.

17. The apparatus according to claim 16, wherein the slider is slideably positioned within a recess defined proximal the communication port.

18. The apparatus according to claim 16, wherein the slider comprises two sliding blocks that are closely-spaced when the slider is in the first position and spaced-apart when the slider is in the second position.

19. The apparatus according to claim 18, wherein the two sliding blocks are biased to be closely-spaced.

20. The apparatus according to claim 19, wherein each of the two sliding blocks are respectively positioned proximal a first and second communication ports.

* * * * *